United States Patent [19]

Wu

[11] Patent Number: 4,468,022

[45] Date of Patent: Aug. 28, 1984

[54] SIT-UP EXERCISE APPARATUS

[76] Inventor: Han-Chou Wu, No. 145, Jen-Ho Rd., Tainan, Taiwan

[21] Appl. No.: 396,469

[22] Filed: Jul. 8, 1982

[51] Int. Cl.[3] ..... A63B 23/02

[52] U.S. Cl. ..... 272/93; 172/900

[58] Field of Search ..... 272/93, 900, 145; 248/224.3, 224.4

[56] References Cited

U.S. PATENT DOCUMENTS

| | | | |
|---|---|---|---|
| 1,969,165 | 8/1934 | Turner | 272/93 |
| 3,430,953 | 3/1969 | Teetor | 272/900 |
| 4,116,434 | 9/1978 | Bernstein | 272/93 |
| 4185,816 | 1/1980 | Bernstein | 272/93 |
| 4323,235 | 4/1982 | Schwarz | 272/93 |

FOREIGN PATENT DOCUMENTS

| | | | |
|---|---|---|---|
| 611803 | 6/1979 | Switzerland | 272/93 |

*Primary Examiner*—Richard J. Johnson

*Attorney, Agent, or Firm*—Lackenbach, Siegel, Marzullo, Presta & Aronson

[57] ABSTRACT

A sit-up exercise apparatus having a structure that can be secured to the bottom of a door which comprises, means for restraining feet of an exerciser when performing a sit-up exercise, support means for supporting the foot restraining means at a height above the base of the structure, and screw means for releasably but rigidly securing the foot restraining means to the support means. The support means is substantially an elongated plate member extending from the structure and having, one end thereof downwardly extending to releasably but rigidly be affixed to the structure and another end thereof successively bent into a form resembling stair steps which accomplish height adjustment of the foot restraining means so as to accomodate different size feet.

1 Claim, 7 Drawing Figures

SIT-UP EXERCISE APPARATUS

BACKGROUND OF THE INVENTION

This invention relates to a device for use in performing a sit-up exercise to strengthen the abdominal muscles.

It is a common practice to restrain the instep portion of the foot when an exerciser performs a sit-up exercise. Various forms of exercise apparatus have existed to facilitate such exercising. As disclosed in U.S. Pat. No. 4,116,434, there is provided a device, as shown in FIGS. 1 and 2, that has a clamping member 1 for securement to the bottom of a door 4 or other structure that can accomplish the same end purpose. A transverse tubular member 2, which restrains the instep portion of the foot by engaging therewith is, rigidly supported by a bracket 3 from the clamping member. For height adjustment of the tubular member so as to be able to engage with different sizes of feet, it is further provided with a rectangular sleeve mounted on the tubular member and adapted to be angularly positioned on the tubular member. Although this device is equipped with height adjustment it is still desirable to develop a device of more simplified construction for ease of handling and reduction in transportation packing size.

SUMMARY OF THE INVENTION

According to the invention there is provided, a sit-up exercise apparatus having a structure that can be securely attached to the bottom of a door which comprises: means for restraining feet of an exerciser when performing a sit-up exercise; support means releasably and rigidly connected to the structure and extending therefrom for supporting the foot restraining means at a height above the base of the structure, a stair (step like) end portion for locating the foot restraining means at different heights; and means for releasably but rigidly securing the foot restraining means at any location on the support means.

Advantageously, the support means is an elongated plate member extending from the structure and having, one end thereof is downwardly extending to releasably but rigidly be affixed to the structure and another end thereof successively bent into a form resembling stair steps.

An object of the invention is to provide a sit-up exercise apparatus of more simplified construction, thereby reducing the production cost thereof.

Another object of the invention is to provide a sit-up exercise apparatus that can be disassembled into separate parts which can be packed in a smaller packing size for reducing the transportation expenses.

These and other objects, features and advantages of the present invention will be more apparent in the following description of a preferred embodiment with reference to the accompanying drawings, in which:

DETAILED DESCRIPTION OF THE PREFERRED EMBODIMENT

Figure 3:
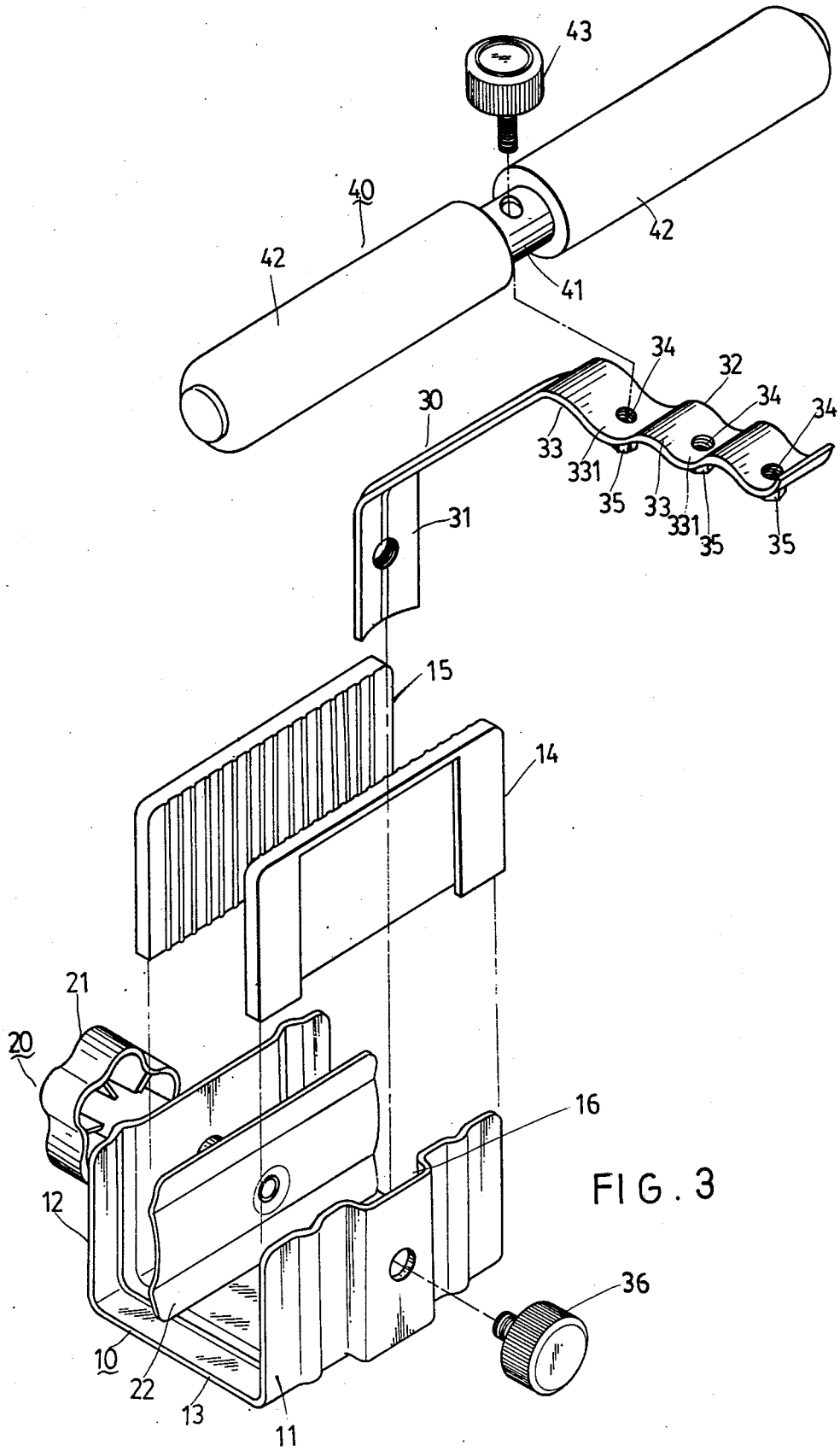
FIG. 3 is an exploded view of a sit-up exercise apparatus constructed according to the present invention.
Figure 4:
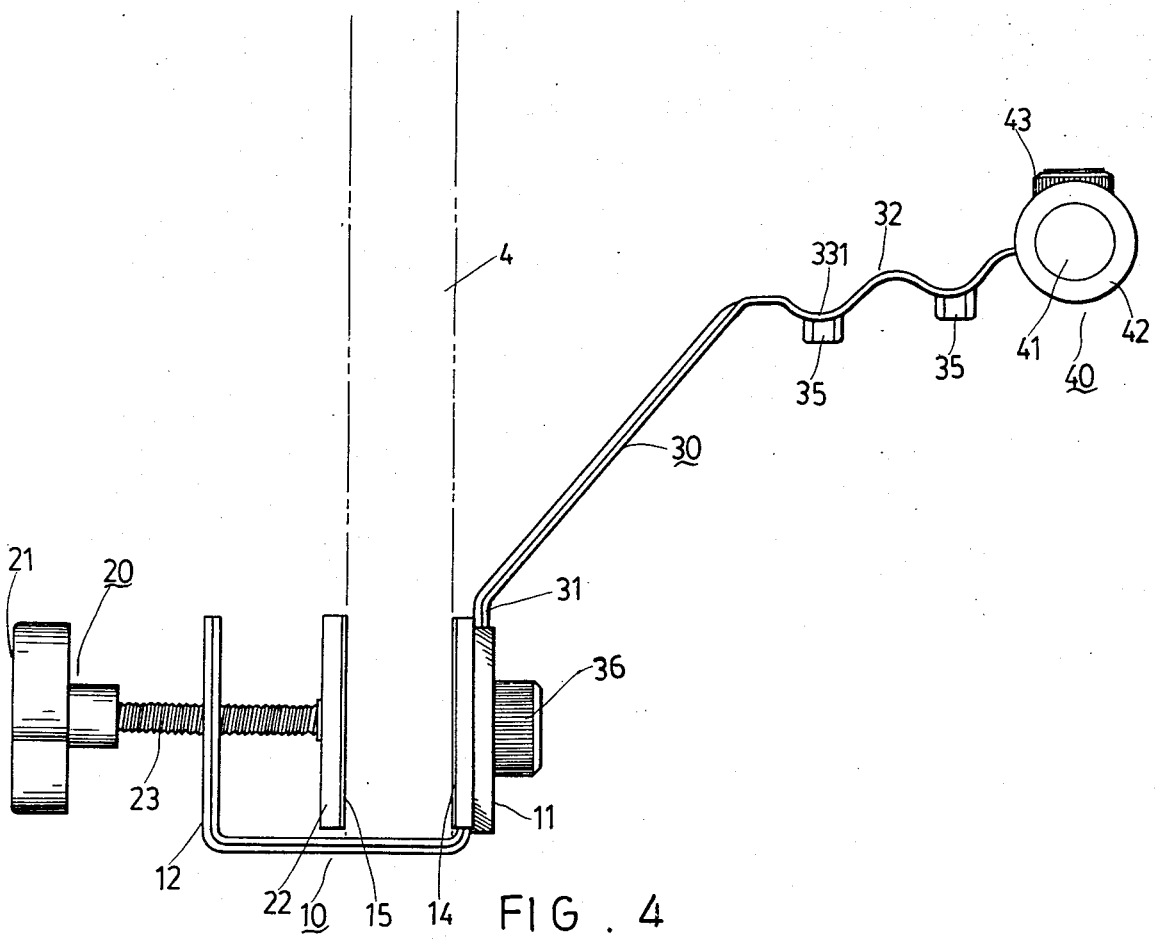
FIG. 4 is a side elevational view of a sit-up exercise apparatus constructed according to the present invention.
Figure 5:
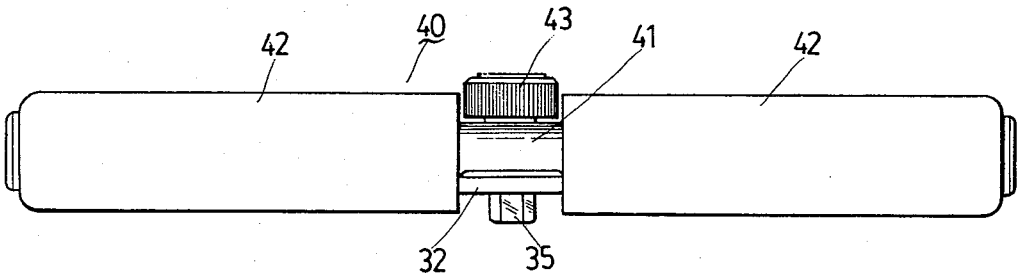
FIG. 5 is a view illustrating the foot restraining means which is secured to the support means.
Figure 6:
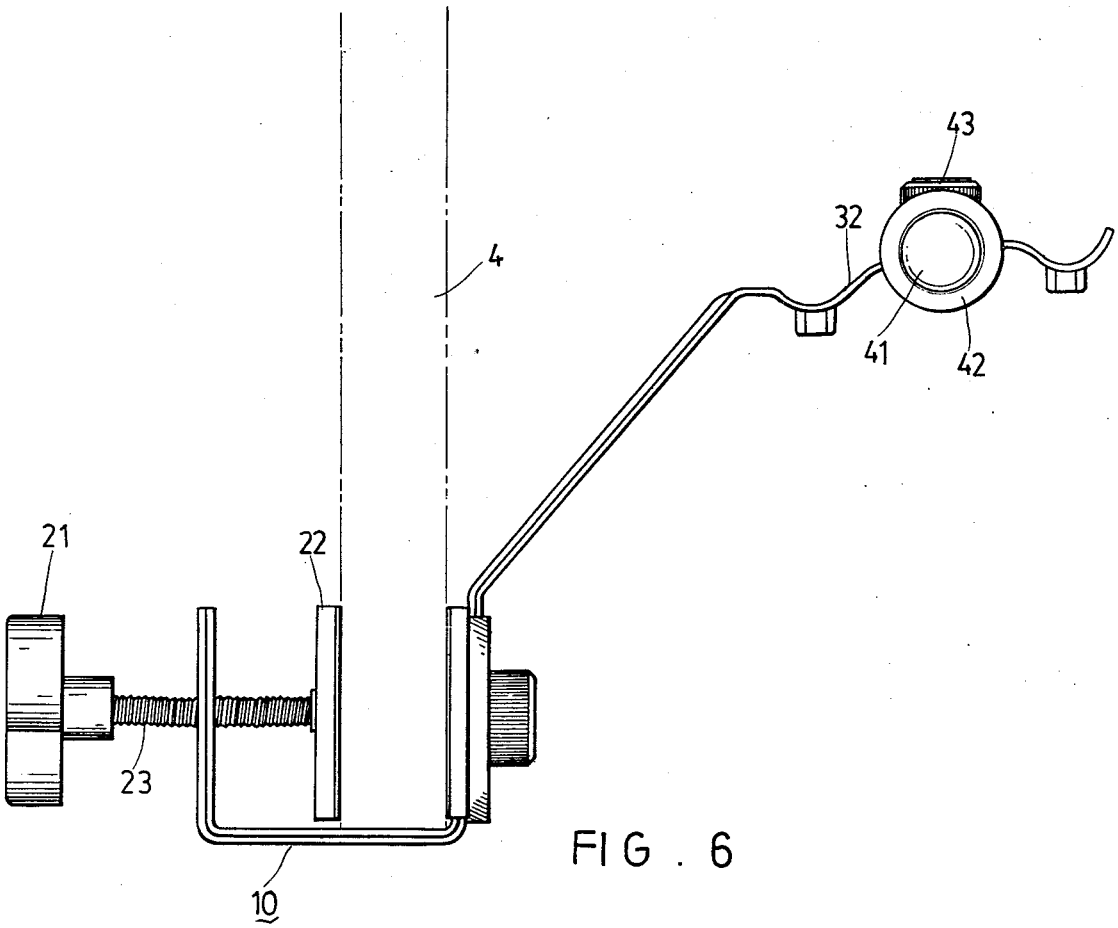
FIG. 6 is a side elevational view illustrating the sit-up exercise apparatus in another position.

In the illustration of an embodiment, the sit-up exercise apparatus comprises a structure adapted to be secured to a door or other structure that can accomplish the same end purpose as is appreciated by one of ordinary skills in the prior art. As best shown in FIG. 3, the structure 10 has two opposing side walls 11 and 12 interconnected by a base member 13 at the bottom ends thereof and is preferably constructed by cold pressing. A clamping means 20 passes through one side wall 12 and includes, a knob 21 for being operated by a hand, a clamping plate 22 for cooperating with the side wall 11 to clamp the bottom portion the door 2, and a threaded portion 23 intermediate the knob 21 and the clamping plate 22, as best shown in FIG. 4. Two resilient members 14 and 15 are separately mounted on the side wall 11 and clamping plate 22 respectively for providing engaging surfaces to abut against the surfaces of the door 2 when the clamping plate 22 is driven toward the side wall 11 through the knob 21.

As embodied herein, there is further provide a support means 30 extending from the structure 10 as shown in FIGS. 3 and 4. The support means 30 is advantageously made of an elongated plate which has one end 31 thereof extending downwardly for receiving in a recess 16 formed between the side wall 11 and the resilient member 14, and another end 32 successively bent to a stair (step like) form. A screw 36 is further provided for securing the downwardly extending end 31 to the structure 10. By means of the screw 36 and recess 16 the support means 30 is rigidly secured to the structure 10 and can be released therefrom by detaching the screw 36.

Referring again to FIGS. 3 and 4, a foot restraining means 40 is further provided for engaging with the instep portion of the feet when the exerciser performs the sit-up exercise. This foot restraining means 40 is substantially is in the form of a tubular member 41 which extends transversely to both sides of the support means 30 and has two roller pads 42 spacedly mounted on the tubular member 41. The intermediate portion of the tubular member 41 is bored so that it can be coupled with the stair (step like) end portion 32 of the support means 30 by means of a screw 43. It can be noted that the end portion 32 is provided with three steps 33 each of which has a slightly concave surface 331 to accomodate the intermediate portion of the tubular member 41 and is provided with a hole 34 to allow the screw 43 to pass therethrough. There are further provided nuts 35 which are suitably welded to the end portion 32 so as to cooperate with the screw 43 to fasten the foot restraining means 40 with the end portion 32. With the screw 43 and the concave surface 331 the foot restraining means 40 can be rigidly supported by the support means 30 and can be released therefrom by detaching the screw 43.

Due to the stair (step like) end portion 32 the foot restraining means 40 can be selectively positioned at three locations of different heights, thereby accomplishing the height adjustment of the foot restraining means 40 to accomodate different size feet.

Figure 1:
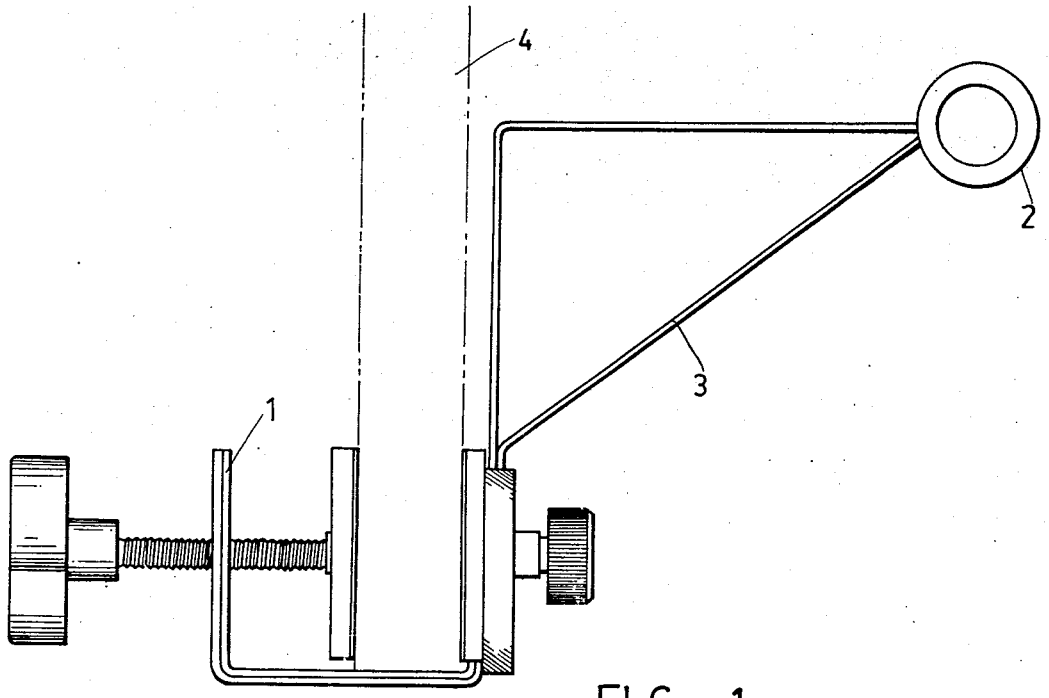
FIG. 1 PRIOR ART
FIG. 1 is a side elevational view of a sit-up exercise apparatus in the prior art.
Figure 2:
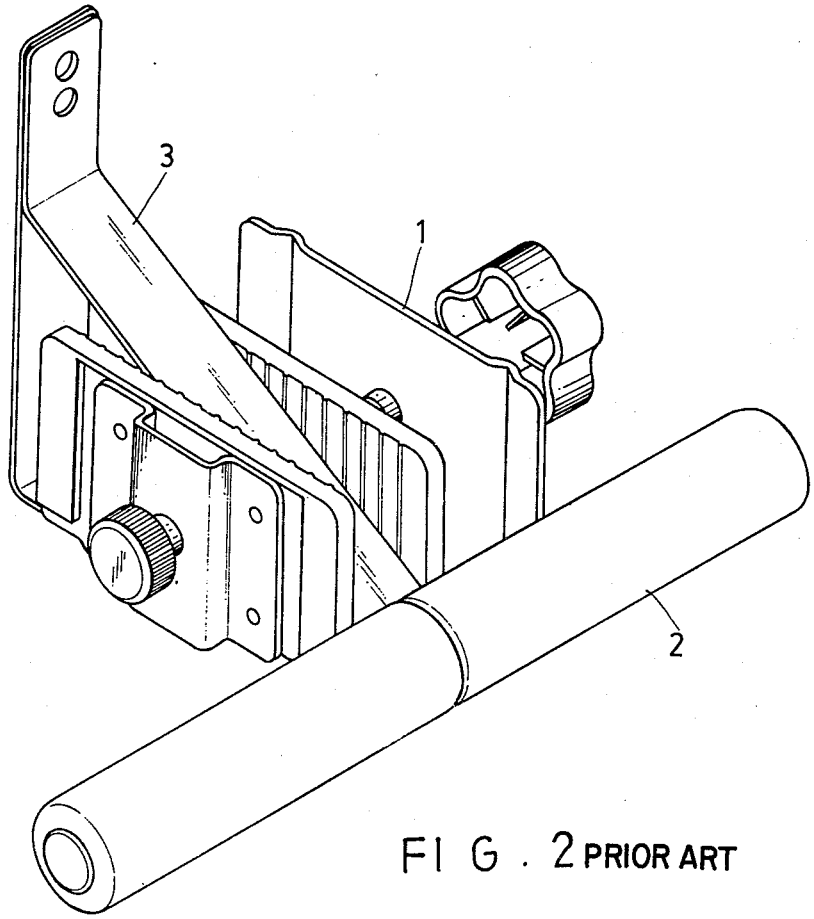
FIG. 2 PRIOR ART
FIG. 2 is a perspective view of a sit-up exercise apparatus in the prior art which is disassembled and put in an arrangement ready for packing.
Figure 7:
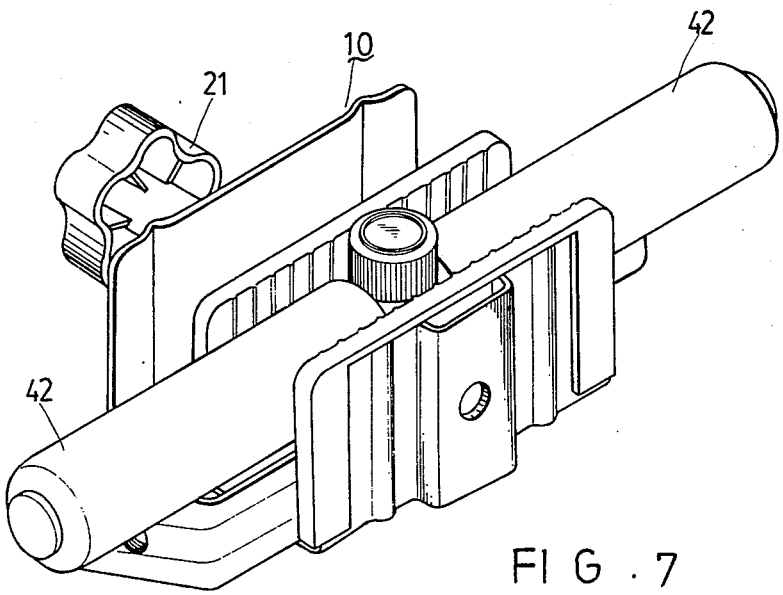
FIG. 7 is a perspective view of the sit-up exercise apparatus constructed according to the invention which is disassembled and put in an arrangement ready for packing.

It can be appreciated from the above discussion that the apparatus 1 can be disassembled into three separate parts, that is, restraining means 40, support means 30 and the structure 10, and these separate parts can be put in an arrangement as illustrated in FIG. 7 which is compact and ready for being encased or packaged in a packaging carton. Comparing FIGS. 2 and 7 it is apparent that the packing size for the apparatus constructed according to the invention is relatively smaller than that of the prior art.

With the invention thus explained, it is apparent that obvious modifications and variations can be made without departing from the scope of the invention. It is therefore intended that the invention be limited only as indicated in the appended claims.

What I claim is:

1. A disassembled sit-up exercise apparatus having a clamping vise-like structure that can be securely attached to the bottom of a door comprising: means for restraining the feet of an exerciser when performing a sit-up exercise; support means releasably but rigidly connected to said structure and extending therefrom for supporting said foot restraining means above the base of said structure, said support means having a stair step configuration at an end portion for locating said foot restraining means at different heights so as to accommodate different size feet, and said support means being in the form of an elongated plate member extending from said clamping vise-like structure and having, one end thereof downwardly extending so as to be releasably but rigidly affixed to said clamping vise-like structure and another end thereof successively bent into a form resembling a plurality of stair steps; and means for releasably but rigidly securing said foot restraining means at any location on said support means; whereby when said apparatus is disassembled, said releasable foot restraining means may be stored in said clamping vise-like structure to facilitate shipping and reduce storage requirements.

* * * * *